US011486658B2

(12) United States Patent
Bruckner et al.

(10) Patent No.: US 11,486,658 B2
(45) Date of Patent: Nov. 1, 2022

(54) STACKED PLATE HEAT EXCHANGER

(71) Applicant: Mahle International GmbH, Stuttgart (DE)

(72) Inventors: Jens Bruckner, Waiblingen (DE); Klaus Irmler, Tuebingen (DE); Jakub Lasica, Stuttgart (DE); Gerd Schleier, Schwaikheim (DE)

(73) Assignee: Mahle International GmbH

( * ) Notice: Subject to any disclaimer, the term of this patent is extended or adjusted under 35 U.S.C. 154(b) by 127 days.

(21) Appl. No.: 16/925,324

(22) Filed: Jul. 9, 2020

(65) Prior Publication Data

US 2021/0010762 A1 Jan. 14, 2021

(30) Foreign Application Priority Data

Jul. 10, 2019 (DE) ..... 102019210238.7

(51) Int. Cl.
*F28D 9/00* (2006.01)
*F28F 3/08* (2006.01)
*F28F 3/06* (2006.01)

(52) U.S. Cl.
CPC ..... *F28F 3/08* (2013.01); *F28F 3/06* (2013.01); *F28D 9/005* (2013.01); *F28D 9/0031* (2013.01)

(58) Field of Classification Search
CPC ..... F28D 9/0031; F28D 9/005; F28F 3/08; F28F 3/06
See application file for complete search history.

(56) References Cited

U.S. PATENT DOCUMENTS 4,434,643 A * 3/1984 Almqvist ..... B21D 53/04 29/890.039
4,781,248 A 11/1988 Pfeiffer
(Continued)

FOREIGN PATENT DOCUMENTS

CN 108603732 A 9/2018
DE 102013220313 A1 4/2015
(Continued)

OTHER PUBLICATIONS

Translation of Japanese Patent Document JP2012002425A entitled Translation—JP2012002425A (Year: 2012).*
(Continued)

*Primary Examiner* — Paul Alvare
(74) *Attorney, Agent, or Firm* — Fishman Stewart PLLC

(57) ABSTRACT

A stacked plate heat exchanger for a motor vehicle is disclosed. The stacked plate heat exchanger includes a plurality of elongated stacked plates extending in a longitudinal direction and stacked against one another perpendicularly to the longitudinal direction in a stacking direction. First hollow spaces and second hollow spaces are disposed between adjacent stacked plates, through which alternatingly a first medium and a second medium flows. At least one stacked plate has a rib structure disposed on a respective plate surface, structured and arranged to provide a plurality of flow passages within the respective hollow space. The rib structure has a guiding region and two distribution regions. The rib structure differs in the guiding region and in the two distribution regions by shape and size of the plurality of flow passages.

20 Claims, 5 Drawing Sheets

(56) References Cited

U.S. PATENT DOCUMENTS

| | | | | |
|---|---|---|---|---|
| 6,394,178 | B1 * | 5/2002 | Yoshida | F28D 9/005 165/166 |
| 8,061,416 | B2 * | 11/2011 | Geskes | F28F 3/046 165/167 |
| 9,448,013 | B2 * | 9/2016 | Ito | F28F 3/025 |
| 10,775,108 | B2 * | 9/2020 | Andersson | F28D 9/005 |
| 2017/0227302 | A1 | 8/2017 | Draenkow et al. | |

FOREIGN PATENT DOCUMENTS

| | | | | | |
|---|---|---|---|---|---|
| DE | 102014226479 | A1 | | 6/2016 | |
| DE | 102016201712 | A1 | | 8/2017 | |
| GB | 1339542 | A | * | 12/1973 | F28F 3/046 |
| JP | 2012002425 | A | * | 1/2012 | |
| WO | WO-2009141379 | | | 5/2009 | |
| WO | WO-2016110472 | | | 7/2016 | |
| WO | WO-2017138322 | | | 8/2017 | |

OTHER PUBLICATIONS

Chinese Office Action dated Sep. 26, 2021 related to corresponding Chinese Patent Application No. 202010658076.9.
Chinese Search Report dated Sep. 17, 2021 related to corresponding Chinese Patent Application No. 202010658076.9.
English abstract for JP-2012002425.
English abstract for DE-102014226479.
English abstract for DE-102013220313.

* cited by examiner

STACKED PLATE HEAT EXCHANGER

CROSS-REFERENCE TO RELATED APPLICATION

This application claims priority to German Application No. DE 10 2019 210 238.7 filed on Jul. 10, 2019, the contents of which are hereby incorporated by reference in its entirety.

TECHNICAL FIELD

The invention relates to a stacked plate heat exchanger for a motor vehicle.

BACKGROUND

A generic stacked plate heat exchanger usually comprises multiple elongated stacked plates which are stacked against one another. Between the adjacent stacked plates hollow spaces are formed in the process which can be alternatingly flowed through by two media—for example refrigerant and coolant. In other words, the adjacent hollow spaces are each separated by a plate surface of the respective stacked plate, so that the two media can exchange heat via the plate surface. The hollow spaces for the respective medium are fluidically connected to one another via two passages, wherein the one passage represents an inflow and the other passage an outflow. Altogether, four passages are thus present in the stacked plate heat exchanger. The plate surface of the respective stacked plates can be structured in order to achieve a high heat transfer between the two media. In doing so, the pressure loss should remain as low as possible and an adequate pressure resistance of the stacked plate heat exchanger achieved. Stacked plate heat exchangers with structured stacked plates are known for example from DE 10 2016 201 712 A1, DE 10 2014 226 479 A1 and WO 2009/141379 A1.

When the width of the stacked plate increases relative to the length, a good transverse distribution of the respective medium has to be ensured, furthermore. Through the conventionally known structuring of the stacked plates however either a good transverse distribution of the two media and thus a good heat transfer between them can be generally achieved or however the pressure losses minimised. When a water-containing medium—such as for example a coolant—is used, the boiling risk in the stacked plate heat exchanger also rises with a poor transverse distribution.

SUMMARY

The object of the invention therefore is to state an improved or at least alternatively embodiment for a stacked plate heat exchanger of the generic type, with which the described disadvantages are overcome. In particular, a good transverse distribution of the media is to be achieved in the stacked plate heat exchanger and the pressure losses in the stacked plate heat exchanger minimised.

According to the invention, this object is solved through the subject of the independent claim(s). Advantageous embodiments are subject of the dependent claims.

A stacked plate heat exchanger is provided for a motor vehicle and comprises multiple elongated stacked plates extending in the longitudinal direction, which are stacked against one another in a stacking direction perpendicularly to the longitudinal direction. Between the adjacent stacked plates, first and second hollow spaces that are closed off towards the outside are formed, through which a first medium and a second medium can alternatingly flow. Here, the first hollow spaces are fluidically connected to two first medium passages located opposite one another in the longitudinal direction and the second hollow spaces to two second medium passages located opposite one another in the longitudinal direction. The respective stacked plate has a rib structure on its plate surface, by which the multiple flow passages that can be flowed through by the respective medium are formed within the respective hollow space. According to the invention, the rib structure comprises a guiding region and two distribution regions, wherein the distribution regions and the guiding region extend transversely to the longitudinal direction and are arranged next to one another in the longitudinal direction. The first medium passages and the second medium passages are formed each within one of the distribution regions. The rib structure differs in the guiding region and in the two distribution regions by shape and size of the respectively formed flow passages, wherein the respectively formed flow passages can be flowed through by the respective medium in the two distribution regions preferably transversely to the longitudinal direction and in the guiding region preferably in the longitudinal direction.

The medium passages are orientated in the stacked plate heat exchanger in the stacking direction and can be flowed through preferably in the stacking direction. The first medium passages and the second medium passages are each arranged located opposite one another in the longitudinal direction, wherein, at a longitudinal end of the stacked plate heat exchanger, the first medium passage and the second medium passage are then each arranged next to one another transversely to the longitudinal direction. In other words, the respective medium passages are formed in corner regions of the stacked plate heat exchanger. The medium passages in the stacked plate heat exchanger are formed by four suitably configured openings in the respective stacked plates. Dome-like dome rims are formed about two of the openings in the respective stacked plate. The respective dome rim protrudes from the plate surface of the respective stacked plate in the stacking direction and sealingly lies against the adjacent stacked plate round about the respective medium passage. In the respective medium passage, the openings alternate with and without dome rim in the stacking direction, so that the first hollow spaces are fluidically separated from the second medium passages and the second hollow spaces from the first medium passages by the respective dome rims.

The two first medium passages each form an inflow and an outflow for the first medium and the two second medium passages each form an inflow and an outflow for the second medium. On the respective stacked plate, the one distribution region is then assigned to the inflow and the other distribution region to the outflow. The distribution region assigned to the inflow then distributes the medium flowing in via the medium passage transversely to the longitudinal direction over the entire width of the hollow space. Following the distribution region assigned to the inflow, the respective medium flows through the guiding region in which it is preferably directed in the longitudinal direction and furthermore over the entire width of the hollow space to the distribution region assigned to the outflow. The distribution region assigned to the outflow then collects the outflow medium to the respective medium passage, so that the respective medium can flow out. The rib structure can be the same or different within the two distribution regions, so that the flow passages within the two distribution regions can have a shape and size that are different from one another or identical to one another. Through the rib structure according to the invention, the distribution of the receptive medium transversely to the longitudinal direction can be significantly improved and the pressure losses in the hollow space reduced. Furthermore, a more even speed profile of the respective medium in the hollow space is achieved through the better distribution of the respective medium in the hollow space and a flow stoppage can be avoided. In particular in the case of water-containing media—such as for example a coolant—a boiling risk can thereby be reduced.

In the stacked plate heat exchanger, the respective stacked plates are fixed to one another in an integrally bonded manner—for example by way of a soldered connection. To this end, the stacked plates have an rim which protrudes from the plate surface in the stacking direction and circulates about the plate surface. The stacked plates are then connected to one another via the respective rims. In order to increase the pressure stability of the stacked plate heat exchanger, the respective adjacent stacked plates can be fixed to one another at some contact points of their rib structure in an integrally bonded manner—for example by means of a soldered connection. Since no sealing connection has to be present at the contact points, the two stacked plates can be soldered together at only a few of these contact points. In addition, the stacked plates can also be fixed about the respective medium passages to the dome rims in an integrally bonded manner—for example by means of a soldered connection. By way of this, the corresponding hollow spaces can also be fluidically sealed against the corresponding medium passages. In addition, a stack of the respective stacked plates can be covered on both sides by a cover plate each. The respective cover plate is then orientated transversely to the stacking direction and can stabilise the stacked plate heat exchanger. The two cover plates can be configured differently from one another. Preferentially, the two cover plates are soldered to the stack. The stacked plate heat exchanger according to the invention can be for example condenser, wherein the first medium is then for example coolant and the second medium for example a refrigerant—for example cyclopentane.

In a further development of the solution according to the invention it is provided that the rib structure comprises multiple ribs. The ribs then follow one another in the longitudinal direction and extend transversely to the longitudinal direction. The respective rib runs zigzag in the plate surface and comprises multiple straight rib portions, wherein the adjacent straight rib portions merge at an angle into one another. This can be realised for example by an angle region. Here, the respective ribs are characterized in that they protrude from the plate surface of the respective stacked plate and are elongated. In a section plane defined by the longitudinal direction and the stacking direction, the plate surface of the respective stacked plate has a wave structure through the ribs following one another.

Advantageously, the respective ribs following one another can have a distance from one another which in the guiding region is smaller than in the two distribution regions. Advantageously it can be provided that the distance of the respective ribs following one another in the guiding region is smaller by a factor 1.3 to 1.7 than in the two distribution regions. By the larger distance between the adjacent ribs in the respective distribution region, the respective medium can be optimally distributed transversely to the longitudinal direction and through the smaller distance of the ribs following one another in the guiding region, a greater heat transfer between the two media can be achieved.

Advantageously it can be provided that the angle between the adjacent inter-merging rib portions in the guiding region is smaller by 5° to 20° than in the two distribution regions. Through the larger angle in the respective distribution region, the flow of the respective medium in the longitudinal direction can be blocked better as a result of which the respective medium preferably flows transversely to the longitudinal direction. Accordingly, a better distribution of the respective medium transversely to the longitudinal direction can thereby be achieved.

Advantageously it can be provided that in the respective distribution region at least one bypass passage is formed. The bypass passage then leads from the guiding region behind the respective distribution region and behind one of the respective medium passages. Here, the bypass passage is arranged adjacent to an edge region of the respective stacked plate. Here, the edge region directly adjoins an rim of the stacked plate which protrudes from the plate surface of the respective stacked plate in the stacking direction and circulates about the plate surface. In other words, the bypass passage is arranged between the rib structure within the distribution region and the rim of the stacked plate. The bypass passage supports the distribution of the respective medium transversely to the longitudinal direction. A width of the bypass passage defined transversely to the longitudinal direction can amount for example to between 1 mm and 4 mm.

Advantageously, the rib structure can reach in the guiding region transversely to the longitudinal direction as far as to an edge region of the respective stacked plate, so that an rim flow of the respective medium in the longitudinal direction is prevented. The edge region directly adjoins an rim of the stacked plate which protrudes from the plate surface of the respective stacked plate in the stacking direction and circulates about the plate surface. In other words, the rib structure within the guiding region adjoins the rim without gap transversely to the longitudinal direction.

In an advantageous further development of the stacked plate according to the invention it is provided that a length of the respective distribution region defined in the longitudinal direction amounts to 10% to 20% of a length of the respective stacked plate defined in the longitudinal direction. Accordingly, a length of the guiding region defined in the longitudinal direction then amounts to 60% to 80% of the length of the respective stacked plate defined in the longitudinal direction.

In a particularly advantageous further development of the stacked plate heat exchanger it is provided that the respective stacked plates are formed identically and, with respect to a width centre axis, mirror-symmetrically. In addition, the stacked plates are alternatingly arranged twisted relative to one another by 180° with respect to central axis. The width central axis is orientated transversely to the longitudinal direction and transversely to the stacking direction and lies centrally in the stacked plate. In other words, the width centre axis divides the stacked plate into two halves that are mirror-symmetrical to one another. Here, the central axis is arranged parallel to the stacking direction and lies in the centre of the respective stacked plate. The stacked plate heat exchanger is thus constructed in that each second one of the identical stacked plates is rotated about the central axis by 180°. Advantageously, the manufacturing effort and also the manufacturing costs can be significantly reduced with this construction of the stacked plate heat exchanger.

On the mirror-symmetrical stacked plate, the rib structure, with respect to the width centre axis, is arranged symmetrically. In other words, the rib structure extends from the width centre axis in the longitudinal direction over a same length on both sides. This applies in the same way to the guiding region of the rib structure, which extends from the width centre axis in the longitudinal direction over the same distance on both sides. The distribution regions are arranged mirror-symmetrically to one another and, from the width centre axis, have an identical distance and an identical length in the longitudinal direction. Accordingly, the rib structure within the two distribution regions is the same so that the flow passages within the distribution regions have an identical shape and size. The first medium passages and the second medium passages are arranged located opposite one another in the longitudinal direction. In other words, each of the identical halves is assigned to one of the first medium passages and one to the second medium passages. The first medium passages and the second medium passages or the openings in the stacked plate assigned to these are each formed identically to one another and each have a same distance from the width centre axis in the longitudinal direction. When the one stacked plate is rotated on the other stacked plate about the central axis by 180°, the openings of the rotated stacked plate are arranged on the openings of the non-rotated stacked plate.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference numbers relate to same or similar or functionally same components.

BRIEF DESCRIPTION OF THE DRAWINGS

It shows, in each case schematically

DETAILED DESCRIPTION

Figure 1:
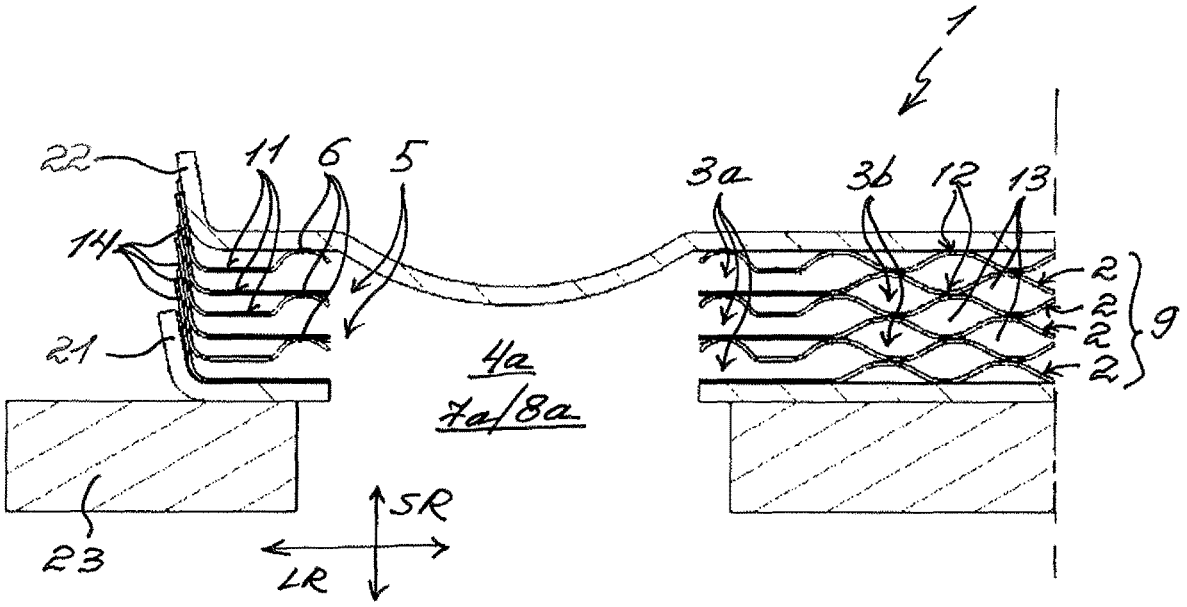
FIGS. 1 and 2: sectional views of a stacked plate heat exchanger according to the invention on a first and a second medium passage each.
Figure 2:
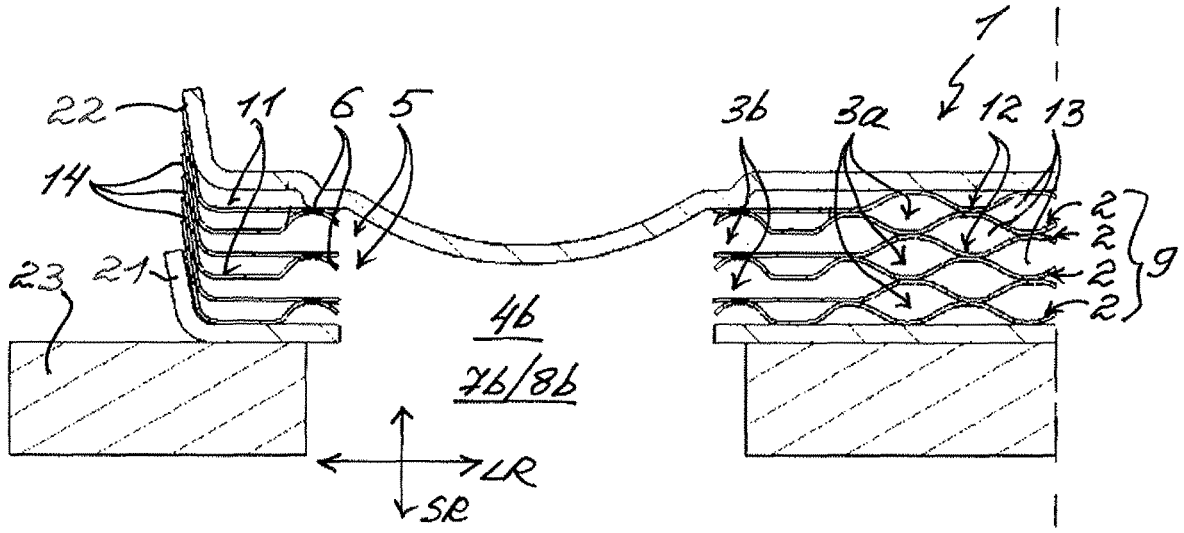
Figure 3:
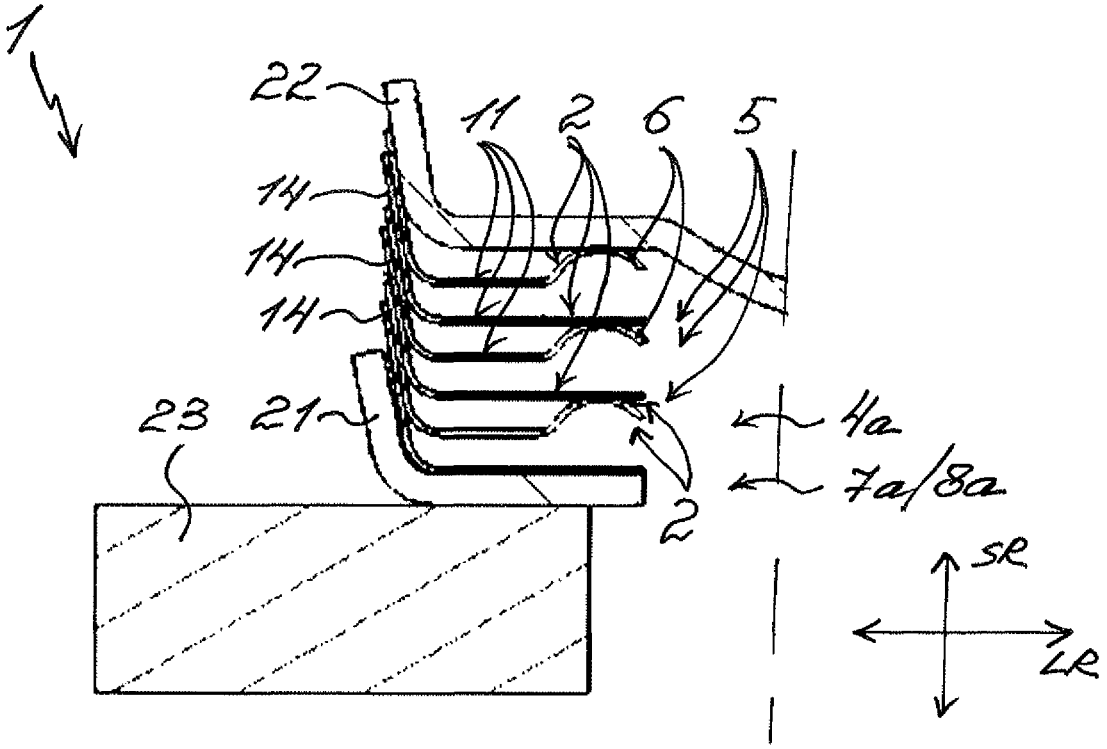
FIG. 3: an enlarged extract of the stacked plate heat exchanger according to the invention from FIG. 1.

FIG. 1 and FIG. 2 show sectional views of a stacked plate heat exchanger 1 according to the invention for a motor vehicle. FIG. 3 shows an enlarged extract of the stacked plate heat exchanger 1 according to the invention from FIG. 1. The stacked plate heat exchanger 1 comprises multiple elongated stacked plates 2 extending in the longitudinal direction LR, which are stacked against one another perpendicularly to the longitudinal direction LR in a stacking direction SR. Between the adjacent stacked plates 2, first hollow spaces 3*a* and second hollow spaces 3*b* are formed, which are closed off towards the outside. The first hollow spaces 3*a* are provided for a first medium and the second hollow spaces 3*b* for a second medium and are arranged alternatingly in the stacking direction SR. The first hollow spaces 3*a* and the second hollow spaces 3*b* are fluidically separated from one another. In the stacked plate heat exchanger 1, two first medium passages 4*a* and two second medium passages 4*b* each are provided, which are formed by openings 5 in the stacked plates 2 situated on top of one another. The respective medium passages 4*a* and 4*b* are orientated in the stacking direction SR. The stacked plate heat exchanger 1 can be for example a condenser, wherein the first medium then is a coolant and the second medium then is a refrigerant or vice versa.

The first hollow spaces 3*a* are fluidically connected to the two first medium passages 4*a* and the second hollow spaces 3*b* to the two second medium passages 4*b*. The two first medium passages 4*a* are fluidically separated from the second hollow spaces 3*a* and the two second medium passages 4*b* from the first hollow spaces 3*b*. For this purpose, dome-like dome rims 6 are alternatingly formed about the openings 5, which are assigned to the respective medium passage 4*a* or 4*b*. The respective dome rims 6 of the one stacked plate 2 are fixed to the adjacent stacked plate 2 so that the respective hollow space 3*a* or 3*b* is fluidically separated from the respective medium passage 4*a* or 4*b*. The first medium passages 4*a* then form an inflow 7*a* and an outflow 8*a* each for the first medium and the second medium passages 4*b* each form an inflow 7*a* and an outflow 8*a* for the second medium. In FIG. 1 and FIG. 3, the sectional views of the stacked plate heat exchanger 1 on the first medium passage 4*a* are shown, which can be both the inflow 7*a* and also the outflow 8*a*. In FIG. 2, the sectional view of the stacked plate heat exchanger 1 on the second medium passage 4*b* is shown, which can be both the inflow 7*b* and also the outflow 8*b*.

The respective stacked plate 2 on its plate surface 11 has a rib structure 12, through which multiple flow passages 13 that can be flowed through by the respective medium are formed. Within the respective hollow space 3*a* and 3*b*, the respective flow passages 13 are fluidically connected to one another and serve for steering the respective medium within the respective hollow space 3*a* and 3*b*. By way of the flow passages 13, the first medium flows through the first hollow spaces 3*a* from the inflow 7*a* to the outflow 8*a* and the second medium flows through the second hollow spaces 3*b* from the inflow 7*b* to the outflow 8*b*. Preferentially, the inflows 7*a* and 7*b* as well as the outflows 8*a* and 8*b* are arranged relative to one another in such a manner that the two media flow through the stacked plate heat exchanger 1 in counter-flow relative to one another.

The stacked plates 2 each have an rim 14 which protrudes from the plate surface 11 of the respective stacked plate 2 in the stacking direction SR. The respective stacked plates 2 are soldered to one another at the rims 14, at the respective dome rims 6 and at some contact points of the rib structures 12 lying against one another. The respective stacked plates 2 stacked against one another form a stack 9 which, on both sides, is closed or enclosed by cover plates 21 and 22. The cover plates 21 and 22 are orientated transversely to the stacking direction SR and are configured differently from one another. The two cover plates 21 and 22 are then each soldered to the, in stacking direction SR, last stacked plate 2. Furthermore, the cover plate 21 is connected to a support plate 23.

Figure 4:
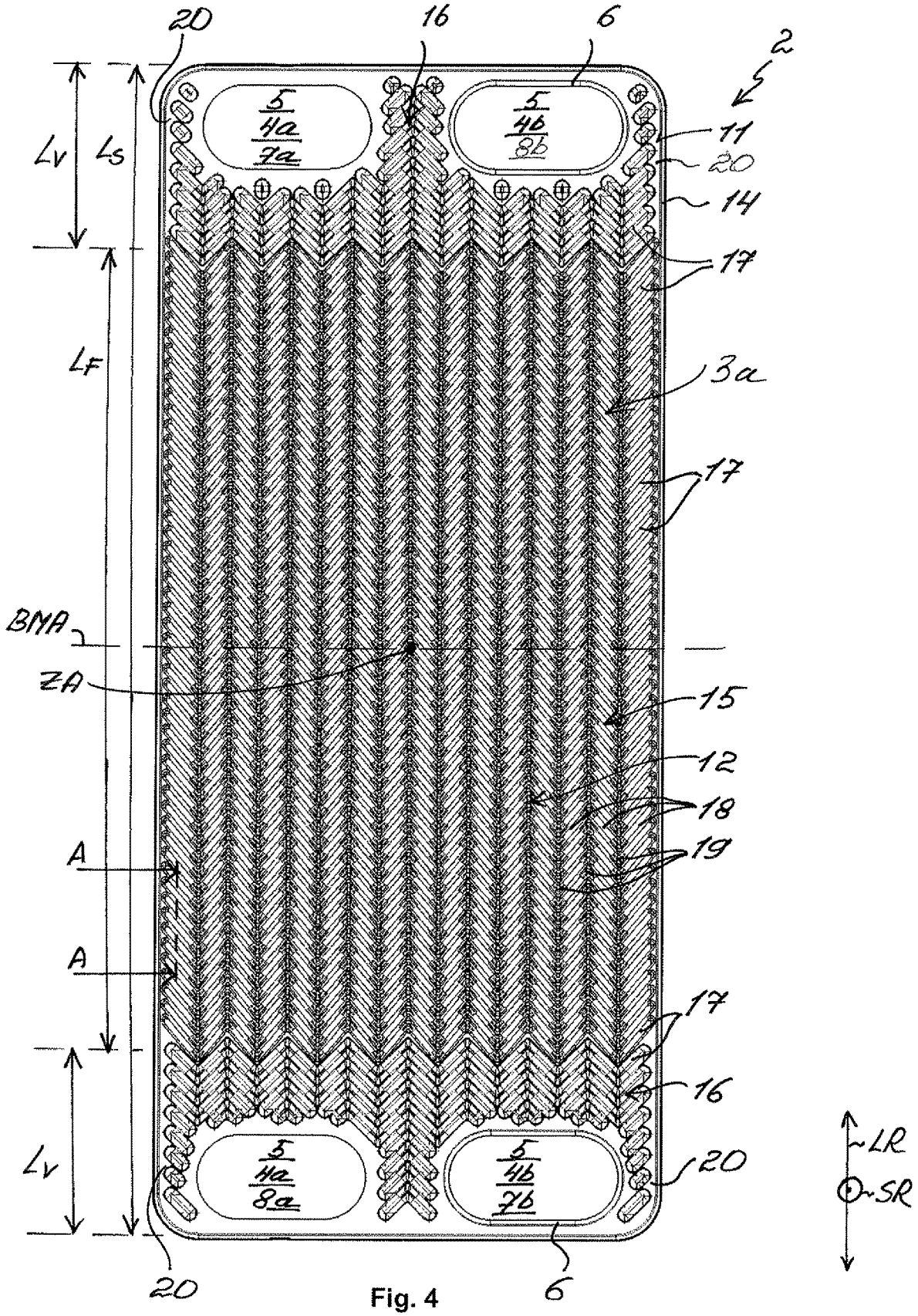
FIGS. 4 and 5: a view and an enlarged view of a stacked plate in the stacked plate heat exchanger according to the invention.
Figure 5:
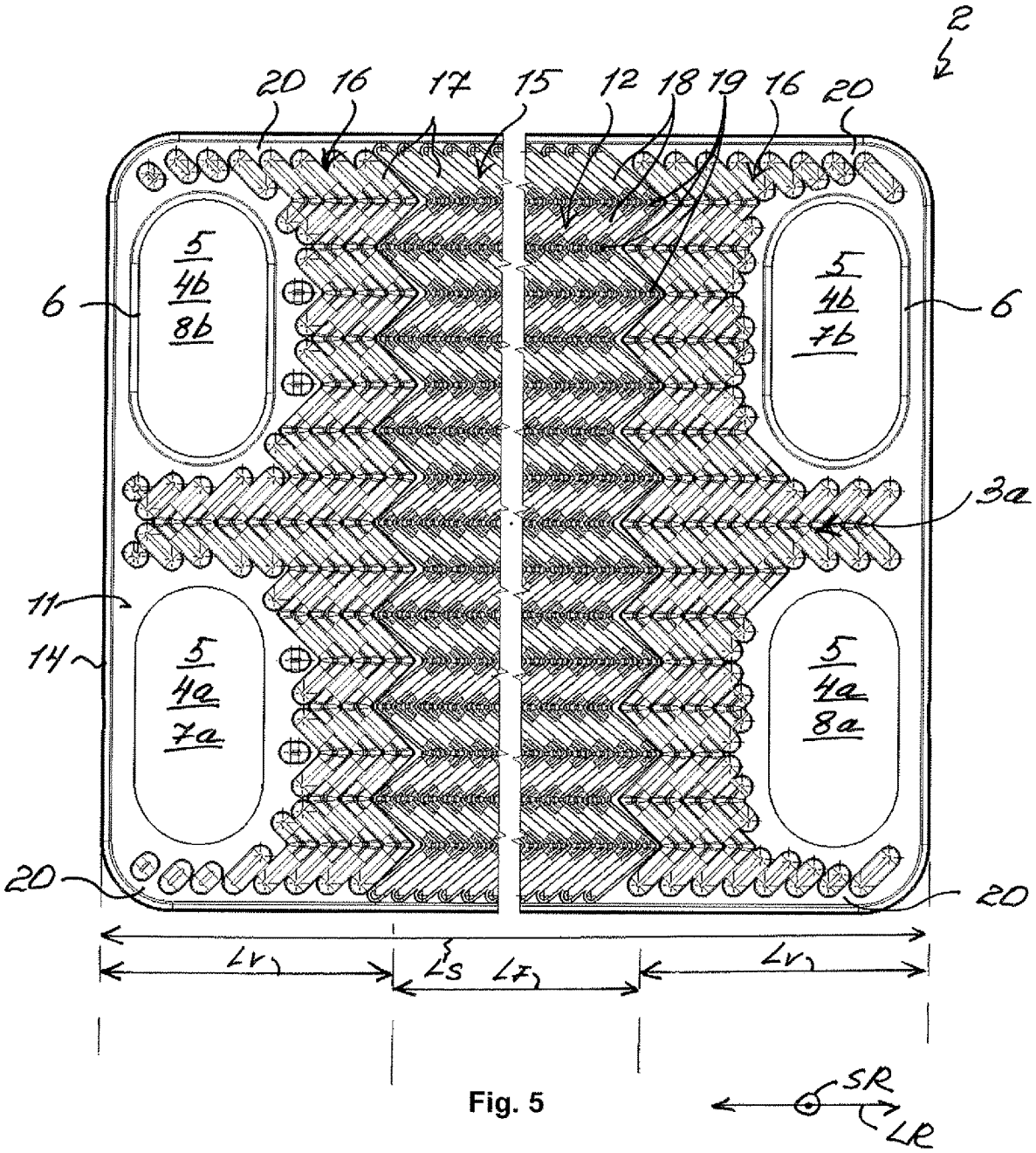
Figure 6:
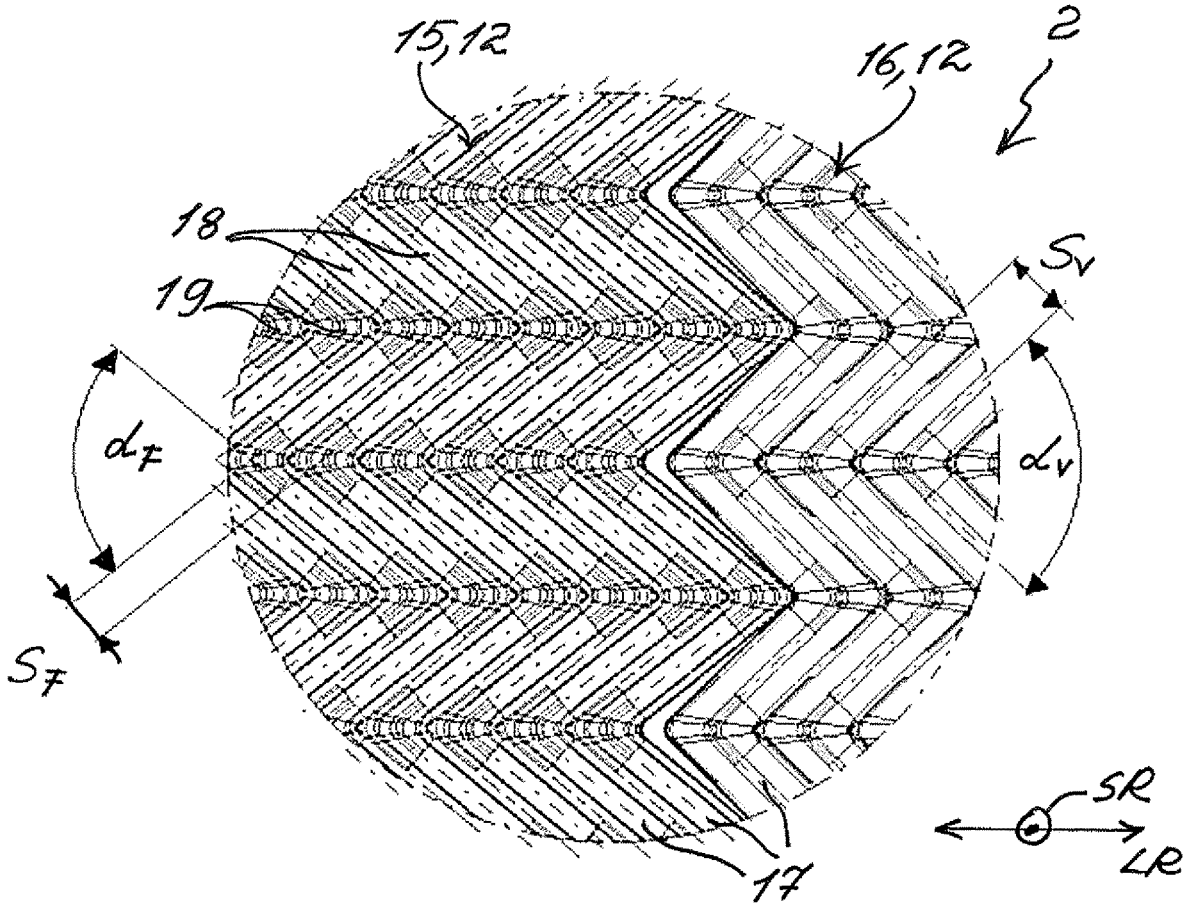
FIG. 6: a view of a rib structure of the stacked plate in the stacked plate heat exchanger according to the invention.
Figure 7:
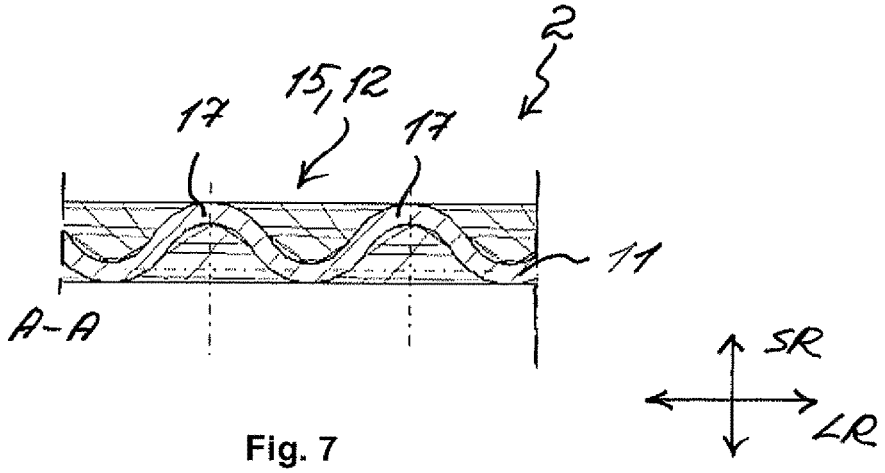
FIG. 7: a sectional view of the stacked plate in a section plane A-A shown in FIG. 4.

FIG. 4 shows a view and FIG. 5 shows an enlarged view of the stacked plate 2 with the rib structure 12. The stacked plate 2 comprises the first medium passages 4*a*, which form the inflow 7*a* and the outflow 8*a* for the first medium. It is to be understood that the inflow 7*a* and the outflow 8*a* can be assigned to the two medium passages 4*a* other than shown. The inflow 7*a* and the outflow 8*a* are arranged located opposite one another and the openings 5 forming the first medium passages 4*a* do not comprise any dome rims 6, so that the first medium can flow towards the stacked plate 2 and away from the same. Accordingly, the hollow space shown here is the first hollow space 3*a*, that can be flowed through with the first medium. Furthermore, the stacked plate 2 comprises second medium passages 4*b*, which form the inflow 7*b* and the outflow 8*b* for the second medium. The inflow 7*b* and the outflow 8*b* are arranged located opposite one another. The dome rims 6 are formed about the corresponding openings 5 of the two medium passages 4*b* so that the hollow space 3*a* shown here is fluidically separated from the inflow 7*b* and from the outflow 8*b*. The inflows 7*a* and 7*b* and the outflows 8*a* and 8*b* are arranged on the stacked plate 2 in such a manner that the two media flow through the stacked plate heat exchanger 1 in counter-flow relative to one another. Since the stacked plates 2 in the stacked plate heat exchanger 1 are identical, the passages 4*a* and 4*b* can also be assigned differently and the shown hollow space can also be the second hollow space 3*b* which can be flowed through with the second medium. It is to be understood in addition that advantages of the stacked plates 2 described below also apply to the hollow spaces 3*a* and 3*b* in the same way. FIG. 6 shows an enlarged view of the rib structure 12 of the stacked plate 2. FIG. 7 shows a sectional view of the stacked plate 2 in the section plane A-A shown in FIG. 4.

Making reference to FIG. 4 and FIG. 5, the rib structure 12 comprises a guiding region 15 and two distribution regions 16, which extend transversely to the longitudinal direction LR over an entire width of the stacked plate 2 and are arranged in the longitudinal direction LR next to one another. Here, the one distribution region 16 is formed about the inflow 7*a* and the outflow 8*b*, the other distribution region 16 about the outflow 8*a* and the inflow 7*b* and the guiding region 15 between the two distribution regions 16. The respective distribution regions 16 are arranged round about the medium passages 4*a* and 4*b*. In other words, the corresponding openings 5 in the respective stacked plate 2 are completely formed within the distribution regions 16. A length Lv of the respective distribution region 16 defined in the longitudinal direction amounts to approximately 10-20% of a defined length Ls defined in the longitudinal direction LR of the respective stacked plate 2. Accordingly, a defined length $L_F$ defined in the longitudinal direction LR of the guiding region 15 amounts to approximately 60-80% of the length Ls of the respective stacked plate 2. The ratio of a width of the stacked plate 2 to the length Ls preferentially amounts to 0.3 to 0.7. For example, the stacked plate 2 can be approximately 180 mm wide and approximately 420 mm long. The rib structure 12 differs in the guiding region 15 and in the two distribution regions 16 by shape and size of the respectively formed flow passages 13, as is explained in more detail in the following by way of FIG. 6.

Here, the rib structure 12 comprises multiple ribs 17 which protrude from the plate surface 11 of the stacked plate 2 in the stacking direction SR and are elongated. The respective rib 17 is formed zigzag-like in the plate surface 11 or on the plate surface 11. The respective rib 17 comprises multiple straight rib portions 18, which are each connected to one another by an angled angular portion 19. Here, the ribs 17 extend transversely to the longitudinal direction LR, wherein understandably the individual rib portions 18 are orientated differently from this. Furthermore, the ribs 17 follow one another in the longitudinal direction LR, as is noticeable in particular in FIG. 7. As is noticeable in FIG. 7, the plate surface 11 of the respective stacked plate 2 has a wave structure in the longitudinal direction LR which, in the stacking direction SR, can be for example 1.4 mm high.

Making reference to FIGS. 4 and 5, two bypass passages 20 each are formed in the respective distribution regions 16. The respective bypass passage 20 leads from the guiding region 15 behind the respective distribution region 16 and behind the respective medium passage 4*a* or 4*b*. The respective bypass passage 20 is formed between the rim 14 and the rib structure 12. The respective bypass passage 20 supports the distribution of the first medium transversely to the longitudinal direction LR. The respective bypass passage 20 can be for example 1 mm to 4 mm wide. In the guiding region 15, the rib structure 12 adjoins the rim 14 of the stacked plate 2 without any gap transversely to the longitudinal direction LR, so that an rim flow of the first medium in the longitudinal direction LR in the guiding region 15 is prevented.

Making reference to FIG. 6, the rib structure 12 differs in the respective distribution region 16 and in the guiding region 15 by a distance of the respective ribs 17 to one another. In particular, the distance $S_V$ of the adjacent ribs 17 is greater in the respective distribution region 16 by a factor between 1.3 and 1.7 than the distance $S_F$ of the adjacent ribs 17 in the guiding region 15. The distance $S_F$ can be for example 3.5 mm and the distance $S_V$ can be for example 5.2 mm. Through the greater distance $S_V$, the first medium in the respective distribution region 16 can be optimally distributed transversely to the longitudinal direction LR and through the smaller distance SR, a greater heat transfer between the two media in the guiding region 15 can be achieved.

In the guiding region 15, the respective rib portions 18 additionally have an angle $\alpha_F$ and in the respective distribution region 16 an angle $\alpha_V$ relative to one another. The angle $\alpha_F$ is smaller by 5° to 20° than the angle $\alpha_V$, so that in the respective distribution region 16 the flow of the respective medium in the longitudinal direction LR can be blocked better or earlier. By way of this, the first medium can preferably flow transversely to the longitudinal direction LR in the respective distribution region 16. Accordingly, a better distribution of the first medium transversely to the longitudinal direction LR can thereby be achieved in the respective distribution region 16. The angle $\alpha_F$ can be for example 80° and the angle $\alpha_V$ can be for example 90°.

Through the rib structure 12 configured in such a manner, the first medium flows in the hollow space 3*a* within the distribution region 16 preferably transversely to the longitudinal direction LR and in the guiding region 15 preferably in the longitudinal direction LR. Because of this, the distribution of the first medium transversely to the longitudinal direction LR can be significantly improved and the pressure losses in the hollow space 3*a* reduced.

Making reference to FIGS. 4 and 5, the respective stacked plate 2 is formed mirror-symmetrically to a width centre axis BMA. The stacked plate heat exchanger 1 can then be formed from identical stacked plates 2, wherein for this purpose every second stacked plate 2 is rotated by 180° about its central axis ZA. Advantageously, the manufacturing effort and also the manufacturing costs can be significantly reduced with this construction of the stacked plate heat exchanger 1.

The invention claimed is:

1. A stacked plate heat exchanger for a motor vehicle, comprising:

a plurality of elongated stacked plates extending in a longitudinal direction and stacked against one another perpendicularly to the longitudinal direction in a stacking direction, wherein between adjacent stacked plates first hollow spaces and second hollow spaces closed off towards the outside are disposed, through which alternatingly a first medium and a second medium flows, the first hollow spaces fluidically connected to two first medium passages located opposite one another in the longitudinal direction and the second hollow spaces fluidically connected to two second medium passages located opposite one another in the longitudinal direction, wherein at least one of the plurality of stacked plates has a rib structure disposed on a plate surface, structured and arranged to provide a plurality of flow passages through which the respective medium flows within the respective hollow space, the rib structure including a guiding region and two distribution regions, wherein the two distribution regions and the guiding region extend transversely to the longitudinal direction and are arranged next to one another in the longitudinal direction, the first medium passages and the second medium passages are each disposed within one of the distribution regions, wherein the rib structure differs in the guiding region and in the two distribution regions by shape and size of the plurality of flow passages, wherein the plurality of flow passages are flowed through by the respective medium in the two distribution regions selectively transversely to the longitudinal direction and in the guiding region selectively in the longitudinal direction, and at least one bypass passage disposed in at least one of the two distribution regions, the at least one bypass passage extending from the guiding region behind the at least one distribution region and behind one of the respective medium passages and which is adjacent to an edge region of the respective stacked plate, wherein the at least one bypass passage is arranged between the rib structure within the at least one distribution region and the edge region.

2. The stacked plate heat exchanger according to claim 1, wherein:

the rib structure comprises a plurality of ribs that follow one another in the longitudinal direction and extend transversely to the longitudinal direction, the plurality of ribs respectively runs zig-zag in the plate surface and have plural straight rib portions, and adjacent straight rib portions of the plurality of ribs merge into one another at an angle.

3. The stacked plate heat exchanger according to claim 2, wherein the plurality of ribs following another have a distance to one another which in the guiding region is smaller than that in the two distribution regions.

4. The stacked plate heat exchanger according to claim 3, wherein the distance of the plurality of ribs following one another is smaller in the guiding region by factor 1.3 to 1.7 than the distance of the plurality of ribs following one another in the two distribution regions.

5. The stacked plate heat exchanger according to claim 2, wherein the angle between the adjacent straight rib portions merging into one another is smaller in the guiding region by 5° to 20° than the angle between the adjacent straight rib portions merging into one another in the two distribution regions at least between the guiding region and the two first medium passages and the two second medium passages in the longitudinal direction.

6. The stacked plate heat exchanger according to claim 1, wherein the at least one bypass passage permits distribution of the respective medium transversely to the longitudinal direction.

7. The stacked plate heat exchanger according to claim 1, wherein a width of the at least one bypass passage defined transversely to the longitudinal direction amounts to between 1 mm and 4 mm.

8. The stacked plate heat exchanger according to claim 1, wherein the rib structure in the guiding region transversely to the longitudinal direction reaches as far as to an edge region of the respective stacked plate, so that a rim flow of the respective medium in the longitudinal direction is blocked.

9. The stacked plate heat exchanger according to claim 1, wherein a length of at least one of the two distribution regions defined in the longitudinal direction amounts to 10% to 20% of a length of the respective stacked plate defined in the longitudinal direction.

10. The stacked plate heat exchanger according to claim 1, wherein the adjacent stacked plates are fixed to one another in an integrally bonded manner at contact points of respective rib structures and about the respective medium passages.

11. The stacked plate heat exchanger according to claim 1, wherein:

the plurality of stacked plates, with respect to a width centre axis arranged transversely to the longitudinal axis and transversely to the stacking direction, are structured mirror-symmetrically, and the plurality of stacked plates are structured identically to one another and are arranged alternatingly rotated by 180° relative to one another with respect to a central axis running parallel to the stacking direction.

12. The stacked plate heat exchanger according to claim 1, wherein the at least one bypass passage includes two bypass passages disposed in the at least one distribution region.

13. The stacked plate heat exchanger according to claim 12, wherein the at least two bypass passages have a width defined transversely to the longitudinal direction that is between 1 mm and 4 mm.

14. The stacked plate heat exchanger according to claim 2, wherein the rib structure in the guiding region transversely to the longitudinal direction reaches as far as to an edge region of the respective stacked plate.

15. A stacked plate heat exchanger for a motor vehicle, comprising:

a plurality of elongated stacked plates extending in a longitudinal direction and stacked against one another perpendicularly to the longitudinal direction in a stacking direction;

a plurality of first hollow spaces and a plurality of second hollow spaces disposed between adjacent stacked plates that are closed off towards the outside, through which alternatingly a first medium and a second medium flows, the plurality of first hollow spaces fluidically connected to two first medium passages located opposite one another in the longitudinal direction and the plurality of second hollow spaces fluidically connected to two medium passages located opposite one another in the longitudinal direction, wherein the plurality of stacked plates respectively have a rib structure including a plurality of ribs disposed on a respective plate surface, structured and arranged to provide a plurality of flow passages within the respective hollow space, the rib structure having a guiding region and two distribution regions, wherein the two distribution regions and the guiding region extend transversely to the longitudinal direction and are arranged next to one another in the longitudinal direction, the first medium passages and the second medium passages are each disposed within one of the two distribution regions, wherein the rib structure differs in the guiding region and in the two distribution regions by shape and size of the plurality of flow passages, wherein the plurality of flow passages are flowed through by the respective medium in the two distribution regions transversely to the longitudinal direction and in the guiding region in the longitudinal direction, and wherein at least one of the plurality of stacked plates has at least one bypass passage disposed in at least one of the two distribution regions, the at least one bypass passage extending from the guiding region behind the at least one distribution region and behind one of the respective medium passages and which is adjacent to an edge region of the respective stacked plate, wherein the at least one bypass passage is arranged between the rib structure within the at least one distribution region and the edge region.

16. The stacked plate heat exchanger according to claim 15, wherein the plurality of ribs respectively run zig-zag on the respective plate surface, and adjacent straight rib portions of the plurality of ribs merge into one another at an angle.

17. The stacked plate heat exchanger according to claim 16, wherein the angle between the adjacent straight rib portions merging into one another is smaller in the guiding region by 5° to 20° than the angle between the adjacent straight rib portions merging into one another in the two distribution regions at least between the guiding region and the two first medium passages and the two second medium passages in the longitudinal direction.

18. The stacked plate heat exchanger according to claim 15, wherein a width of the at least one bypass passage defined transversely to the longitudinal direction amounts to between 1 mm and 4 mm.

19. The stacked plate heat exchanger according to claim 15, wherein the plurality of ribs of the rib structure in the guiding region transversely to the longitudinal direction reaches as far as to an edge region of the respective stacked plate, so that a rim flow of the respective medium in the longitudinal direction is blocked.

20. The stacked plate heat exchanger according to claim 15, wherein a length of at least one of the two distribution regions defined in the longitudinal direction amounts to 10% to 20% of a length of the respective stacked plate defined in the longitudinal direction.

* * * * *